US008478085B2

(12) United States Patent
Kim

(10) Patent No.: US 8,478,085 B2
(45) Date of Patent: Jul. 2, 2013

(54) INKJET HEAD CHIP AND INKJET PRINT HEAD USING THE SAME

(75) Inventor: Yang-hoe Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 419 days.

(21) Appl. No.: 12/544,383

(22) Filed: Aug. 20, 2009

(65) Prior Publication Data

US 2009/0309911 A1 Dec. 17, 2009

(51) Int. Cl.
*B41J 29/38* (2006.01)

(52) U.S. Cl.
USPC ..... 385/14

(58) Field of Classification Search
USPC ..... 347/14
See application file for complete search history.

(56) References Cited

U.S. PATENT DOCUMENTS

| | | | | |
|---|---|---|---|---|
| 5,504,507 | A * | 4/1996 | Watrobski et al. | 347/19 |
| 5,719,605 | A * | 2/1998 | Anderson et al. | 347/59 |
| 6,036,297 | A * | 3/2000 | Hayasaki | 347/13 |
| 2005/0035998 | A1 * | 2/2005 | Ando et al. | 347/47 |

* cited by examiner

*Primary Examiner* — Uyen Chau N Le
*Assistant Examiner* — Hoang Tran
(74) *Attorney, Agent, or Firm* — Stanzione & Kim, LLP

(57) ABSTRACT

An inkjet head chip and an inkjet print head including the inkjet head chip includes a plurality of nozzles, a plurality of discharging units which discharge ink through the plurality of nozzles, a main pad which is electrically connected to the plurality of discharging units in order to supply a driving signal to the plurality of discharging units, and a test pad which supplies a test driving signal to some of the discharging units. The test driving signal is supplied to the test pad to determine similar printing characteristics of a plurality of inkjet head chips.

22 Claims, 7 Drawing Sheets

INKJET HEAD CHIP AND INKJET PRINT HEAD USING THE SAME

CROSS-REFERENCE TO RELATED APPLICATIONS

This application claims priority under 35 USC §119 from Korean Patent Application No. 10-2009-0001599, filed on Jan. 8, 2009, in the Korean Intellectual Property Office, the disclosure of which is incorporated herein in its entirety by reference.

BACKGROUND

1. Field of the General Inventive Concept

The present general inventive concept relates to an inkjet head chip including a plurality of nozzles and an inkjet print head including the inkjet head chip.

2. Description of the Related Art

In general, an inkjet type image forming apparatus refers to an apparatus which ejects ink from a shuttle type inkjet print head onto a sheet of printing paper in order to form an image, wherein the shuttle type inkjet print head shuttles in a main scanning direction, and the sheet of printing paper is transferred in a sub-scanning direction. An inkjet print head includes one or more inkjet head chips which include a plurality of nozzles discharging ink and a discharging unit providing an ink discharge pressure.

In order to realize high-speed printing, an array inkjet print head has been proposed. An array inkjet print head includes a nozzle unit having a length in a main scanning direction which corresponds to a width of a sheet of printing paper, instead of a shuttle type inkjet head. An inkjet type image forming apparatus using such an array inkjet print head transfers only sheets of printing paper in a sub-scanning direction. Therefore, a simple structure of a driving device of the inkjet type image forming apparatus and high-speed printing may be realized. A plurality of inkjet head chips are arrayed in a main scanning direction to cover a width of a sheet of printing paper in order to manufacture an array inkjet print head. The array inkjet print head may also be divided into two sub-heads which include nozzle units each having a length to correspond to half of the width of the sheet of printing paper. The two sub-heads are separated from each other by a predetermined space in the sub-scanning direction. Also, the two sub-heads may separately move in the main scanning direction. The two sub-heads may be positioned in a line in the main scanning direction to cover the whole width of the sheet of printing paper so as to print an image at a fixed position on the sheet of printing paper which is transferred in the sub-scanning direction. Both or one of the two sub-heads may be transferred in the main scanning direction in order to compensate for defective nozzles or improve resolution.

In general, inkjet head chips are manufactured using a similar process to a semiconductor manufacturing process such as a complementary metal-oxide semiconductor (CMOS) process, a micro-electromechanical systems (MEMS) process, or the like. A plurality of inkjet head chips are manufactured from one wafer. When inkjet head chips pass test printing and thus meet predetermined quality standards, they are applied to an inkjet print head. However, even if inkjet head chips manufactured using the same process meet predetermined quality standards, all of them may not have the same printing characteristics. For example, even if inkjet head chips are manufactured using the same process, discharge rates of ink, sizes of ink drops, and distances between nozzles may be slightly different. In the case of an inkjet print head using a plurality of inkjet head chips, in particular, an array inkjet print head, printing characteristic differences among the plurality of inkjet head chips are reflected on a printed image. Accordingly, manufacturing an inkjet print head using a plurality of inkjet head chips having similar printing characteristics becomes more difficult when favorable printing quality is desired.

SUMMARY

The present general inventive concept provides an inkjet head chip capable of preventing a main pad, which is to be connected to a driving circuit, from being damaged in a process of testing printing characteristics of the inkjet head chip and an inkjet print head using the inkjet head chip.

Additional aspects and utilities of the present general inventive concept will be set forth in part in the description which follows and, in part, will be obvious from the description, or may be learned by practice of the general inventive concept.

Embodiments of the present general inventive concept may be achieved by providing an inkjet head chip including a plurality of nozzles, a plurality of discharging units which discharge ink through the plurality of nozzles, a main pad which is electrically connected to the plurality of discharging units in order to supply a driving signal to the plurality of discharging units, and a test pad which supplies a test driving signal to some of the plurality of discharging units.

The plurality of nozzles may include main nozzles to print and test nozzles which are positioned separately from the main nozzles, wherein the test pad is electrically connected to the discharging units which correspond to the test nozzles.

The plurality of nozzles may include a plurality of nozzle lines which are spaced apart from one another, wherein the test pad is electrically connected to the discharging units which correspond to at least one nozzle of each of the plurality of nozzle lines.

At least one of the plurality of nozzle lines may discharge different colored ink from ink which is discharged from the other nozzle lines.

Embodiments of the present general inventive concept may also be achieved by providing an inkjet print head including, a plurality of the inkjet head chips described above, and a plurality of connectors which are electrically connected to the main pads of the plurality of inkjet head chips in order to supply a driving signal to the plurality of inkjet head chips.

The plurality of inkjet head chips may be arrayed in a length to corresponds to a width of a sheet of printing paper. The plurality of inkjet head chips may be arrayed in a zigzag formation.

Embodiments of the present general inventive concept may also be achieved by providing an inkjet print head including, a plurality of the inkjet head chips described above, and a circuit board which include a plurality of connection pads electrically connected to the main pads of the plurality of inkjet head chips.

The circuit board may include a multi-layer ceramic circuit board.

The plurality of inkjet head chips may be arrayed in a length which corresponds to a width of a sheet of printing paper. The plurality of inkjet head chips may be arrayed in a zigzag formation.

The plurality of inkjet head chips may be arranged in the circuit boards to form a plurality of head modules which are combined with the circuit board. The plurality of head modules may be arrayed in a length which corresponds to a width of a sheet of printing paper. The plurality of inkjet head chips may be arrayed in a zigzag formation.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE EMBODIMENTS

The present general inventive concept will now be described more fully with reference to the accompanying drawings, wherein like numerals refer to the like elements throughout. Exemplary embodiments of the present general inventive concept are shown by referring to the figures.

Figure 1:
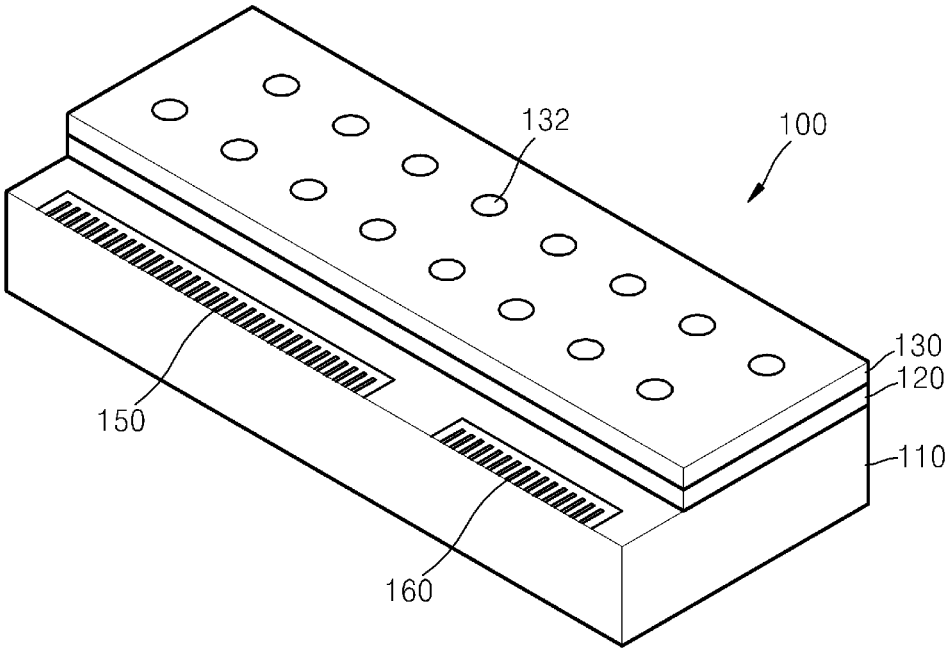
FIG. 1 is a perspective view illustrating an inkjet head chip according to an embodiment of the present general inventive concept.
Figure 2:
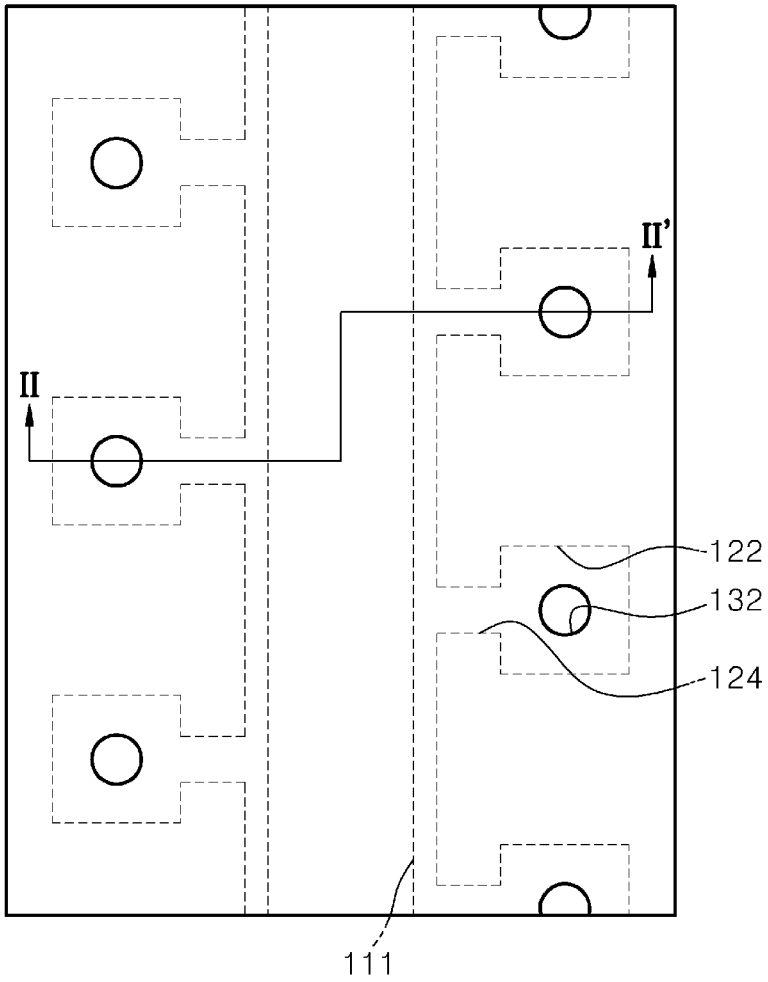
FIG. 2 is a schematic plan view illustrating the inkjet head chip of FIG. 1, according to an embodiment of the present general inventive concept.
Figure 3:
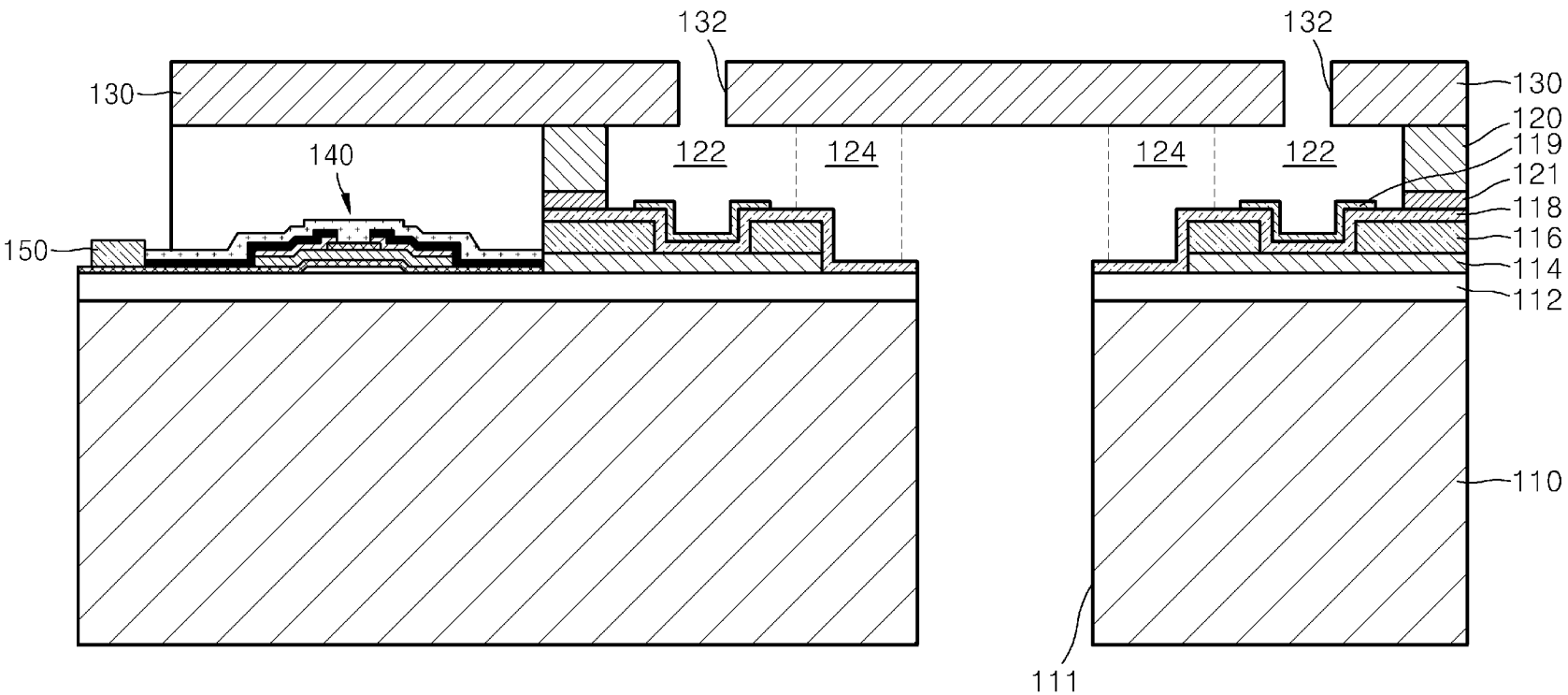
FIG. 3 is a cross-sectional view illustrating the inkjet head chip of FIG. 1 taken along a line II-II' of FIG. 2.

As illustrated in FIGS. 1 through 3, an inkjet head chip 100 may apply pressure to ink, which is fed from an ink container (not illustrated), using a predetermined discharging unit in order to discharge the ink through a nozzle 132. The discharging unit may be a heater 114 applying heat to the ink, which is contained in an ink chamber 122, to generate bubbles so as to discharge the ink by force applied to the bubbles. The discharging unit may also discharge the ink through changes in volume of the ink in the ink chamber, wherein the changes in the volume of the ink are caused by the deformation of a piezoelectric material.

Hereinafter, an inkjet head chip using a heater as a discharging unit will be further described.

FIG. 1 is a perspective view illustrating an inkjet head chip 100 according to an embodiment of the present general inventive concept. FIG. 2 is a schematic plan view of the inkjet head chip 100 of FIG. 1, according to an embodiment of the present general inventive concept. FIG. 3 is a cross-sectional view illustrating the inkjet head chip 100 taken along a line II-II' of FIG. 2.

Referring to FIGS. 1 through 3, the inkjet head chip 100 according to the present embodiment includes a substrate 110, a chamber layer 120, and a nozzle layer 130. The substrate 110 may be generally a silicon substrate, but the present general inventive concept is not limited thereto. Ink feed holes 111 are formed in the substrate 110 so as to feed ink through the chamber layer 120. A plurality of ink chambers 122 are formed in the chamber layer 120 so as to contain ink which is to be discharged. Though only one ink feedhole 111 is illustrated in FIGS. 2 and 3, the semiconductor substrate supports multiple inkjet head chips 100 which in turn includes multiple ink feedholes 111 disposed throughout the inkjet head chips 100. A plurality of nozzles 132 are formed in the nozzle layer 130 so as to discharge the ink.

An insulating layer 112 is formed on an upper surface of the substrate 110 so as to insulate the substrate 110 from a plurality of heaters 114. The insulating layer 112 may be formed of a silicon oxide. The plurality of heaters 114 are formed on an upper surface of the insulating layer 112 in order to heat the ink contained in the ink chambers 122 so as to generate bubbles. The heaters 114 may be formed of a heating resistant material such as an alloy of a transition metal such as tantalum (Ta) and aluminum (Al), Ta nitride, titanium (Ti) nitride, tungsten (W) silicide, or the like. However, the present general inventive concept is not limited thereto. A plurality of electrodes 116 are formed on an upper surface of each of the heaters 114. The electrodes 116 apply current to the heaters 114 and may be formed of a highly electroconductive material such as Al, an Al alloy, gold (Au), silver (Ag), copper (Cu), allows thereof including other metals, or the like.

A passivation layer 118 formed on upper surfaces of the heaters 114 and the electrodes 116. Here, the passivation layer 118 prevents the heaters 114 and the electrodes 116 from being oxidized or eroded due to contact with the ink and may be formed of a silicon nitride or a silicon oxide. An anti-cavitation layer 119 may be formed on an upper surface of the portion of the passivation layer 118 directly disposed on the heaters 114. Here, the anti-cavitation layer 119 prevents the heaters 114 from being damaged by a cavitation force which is generated during the disappearance or expulsion through the nozzles 132 of the bubbles, and may be formed of a transition metal such as Ta.

A glue layer 121 is formed on the passivation layer 118 in order to increase an adhesive strength between the chamber layer 120 and the substrate 110. The glue layer 121 may include a photosensitive resin, and in particular, a negative type photosensitive resin.

The chamber layer 120 stacked on the glue layer 121. The plurality of ink chambers 122 are formed in the chamber layer 120 so as to contain ink which is fed through the ink feed holes 111. A plurality of restrictors 124 may be further formed in the chamber layer 120 to become connection passages between the ink feed holes 111 and the ink chambers 122. The chamber layer 120 may include a negative type photosensitive resin.

The nozzle layer 130 is stacked on the chamber layer 120. The plurality of nozzles 132 are formed in the nozzle layer 130 so as to discharge the ink fed through the ink feed holes 111. The nozzle layer 130 may also include a negative type photosensitive resin.

Referring to FIG. 3, a plurality of driving devices 140 are formed to drive the heaters 114. The driving devices 140 may be formed as thin film transistors (TFTs) above the substrate 110. The plurality of driving devices 140 correspond to the plurality of heaters 114 on at least a one-to-one basis. Alternatively, a single driving device 140 may be configured to correspond to two, four, or multiple plurality of heaters. Structures of TFTs and wiring structures to drive a plurality of heaters 114, e.g., matrix structures, are well known in the art, and thus detailed descriptions thereof will not be provided here.

Figure 4:
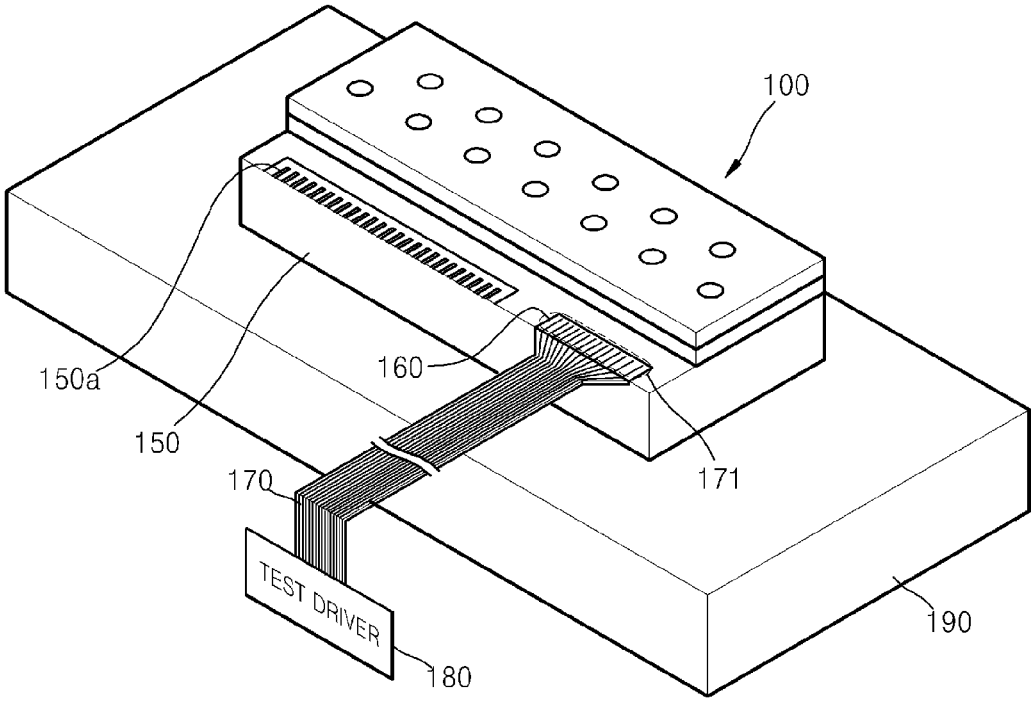
FIG. 4 is a perspective view illustrating the inkjet head chip of FIG. 1 disposed on a tester in order to test printing characteristics of the inkjet head chip.

Referring to FIGS. 1, 3 and 4, a main pad 150 and a test pad 160 are disposed on the substrate 110. A plurality of driving devices 140 are connected to the main pad 150 and to the test pad 160. The main pad 150 may be connected to a main driver of an inkjet type image forming apparatus through a main connector as denoted by reference numeral 220 of FIG. 7. The main pad 150 may also be connected to the main driver of an inkjet type image forming apparatus through a flexible printed circuit board (FPC) 310 of FIGS. 8 and 9 or the like. The driving devices 140 may receive a driving signal from the main driver or through a test driver 170 through the main connector or through the test connector in order to drive the plurality of heaters 114.

As illustrated in FIG. 4, the main pad 150 includes a plurality of electrical terminals 150*a* that connect the main connector (not illustrated) to the main driver.

After the inkjet head chip 100 is manufactured, a test may be performed in order to check whether the inkjet head chip 100 meets predetermined quality standards and to check printing characteristics of the inkjet head chip 100. FIG. 4 is a perspective view of the inkjet head chip 100 disposed on a tester in order to test printing characteristics of the inkjet head chip 100. Referring to FIG. 4, the tester may include an ink feeder 190 which feeds ink to the inkjet head chip 100 and a test driver 180 which may drive a portion of the discharging units of the inkjet head chip 100. FIG. 1 illustrates the nodes of the test pad 160 when not connected to the test connector 170.

The test pad 160 is connected to the driving devices 140 which drive some of the nozzles 132 of the inkjet head chip 100. Thus, the main pad 150 may be used to drive a first portion of the nozzles 132, and the test pad 160 may be used to drive a second portion of the nozzles 132. When in test mode, the driving signal may be supplied only to some of the heaters 114 through the test pad 160 so as to discharge the ink through a selected amount of the nozzles 132. Thus, specified driving devices 140 may be separately prepared for the test. A test connector 170 such as a FPC or the like may be bonded to the test pad 160 in order to perform the test. When the test is completed, the test connector 170 may be separated from the test pad 160.

When the test connector 170 is connected to the test pad 160, the test connector 170 may be encapsulated by an encapsulant 171 such as a resin or the like in order to prevent an electrical short-circuit between a plurality of electrical contacts on the test connector 170 and between a plurality of electrical terminals on the test pad 160 which may be caused by the ink during the test. When the test is completed, the test connector 170 may be separated from the test pad 160 to determine which of the inkjet head chips 100 have nozzles with similar printing characteristics. The inkjet head chips 100 are sorted out according to their checked printing characteristics in order to manufacture inkjet print heads 200 with similar printing characteristics after the test is completed. However, it is not easy to separate the encapsulant 171 from the test connector 170, and the test pad 160 may be damaged during the separation of the encapsulant 171. Thus, the present general inventive concept uses test pads 160 to test various features of inkjet head chips 110, which prevents main pads 150 from being damaged if used for testing of the chips. If the main pads 150 were used for test purposes, even if the tested inkjet head chips 100 meet quality standards, the inkjet head chips 100 would not be able to be used to manufacture an inkjet print head due to damage to the main pads 150. Thus, even if the test pad 160 is damaged after the testing is complete, the inkjet head chips 100 may be used to manufacture an inkjet print head.

A plurality of inkjet head chips 100 are manufactured from one wafer in a manufacturing process. Nozzles formed in one inkjet head chip 100 have similar printing characteristics. Thus, determining the printing characteristics of a portion of the nozzles in an inkjet head chip 100 may be representative of the printing characteristics of all of the nozzles of the inkjet head chip 100. Therefore, the inkjet head chip 100 of the present embodiment separately includes the test pad 160 to drive some of the nozzles 132 in order to connect the test connector 170 to the test pad 160 during the test. Thus, the main pad 150 is not used at all during the test and thus is not damaged. The number or placement of nozzles 132 connected to the test pad 160 is not particularly limited.

Figure 5:
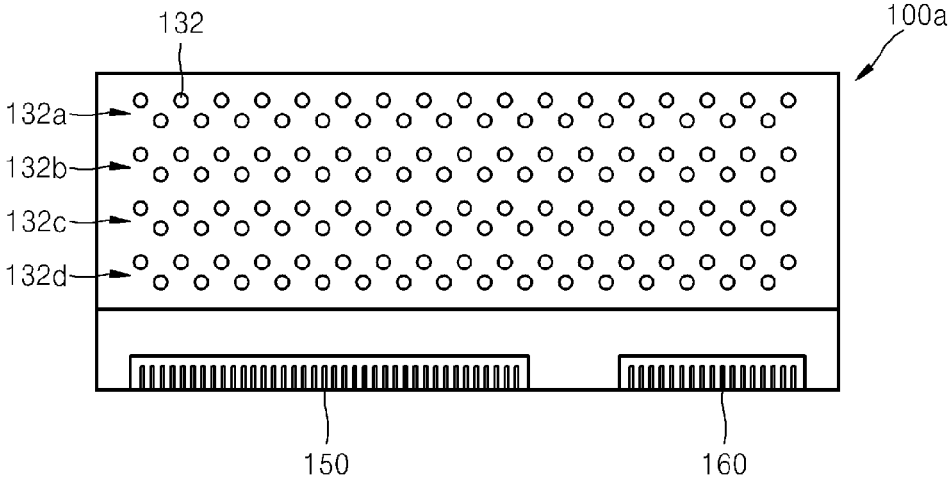
FIG. 5 is a plan view illustrating an inkjet head chip according to another embodiment of the present general inventive concept.

FIG. 5 is a plan view illustrating an inkjet head chip 100*a* according to another embodiment of the present general inventive concept. Referring to FIG. 5, the inkjet head chip 100*a* according to the present embodiment may include a plurality of nozzle lines 132*a*, 132*b*, 132*c*, and 132*d*. Nozzles 132 of the nozzle lines 132*a*, 132*b*, 132*c*, and 132*d* may respectively discharge different colors of ink. For example, the nozzle lines 132*a*, 132*b*, 132*c*, and 132*d* may respectively discharge black (K), yellow (Y), magenta (M), and cyan (C) colored ink. In this case, the test pad 160 may be electrically connected to the heaters 114, which correspond to at least one of the nozzles 132 of each of the plurality of nozzle lines 132*a*, 132*b*, 132*c*, and 132*d*, in order to supply a driving signal to the heaters 114.

Figure 6:
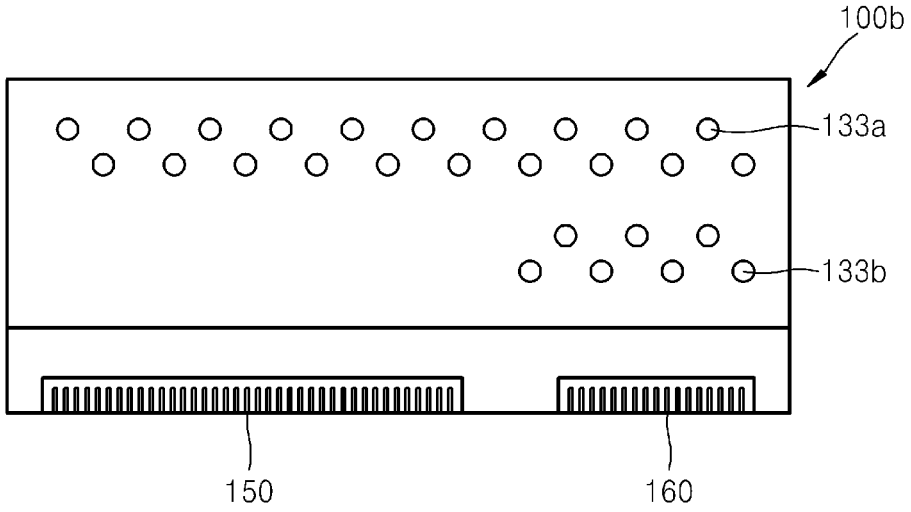
FIG. 6 is a plan view illustrating an inkjet head chip according to another embodiment of the present general inventive concept.

FIG. 6 is a plan view illustrating an inkjet head chip 100*b* according to another embodiment of the present general inventive concept. Referring to FIG. 6, the inkjet head chip 100*b* according to the present embodiment may include a plurality of main nozzles 133*a* which are connected to a main pad 150 to print and a plurality of test nozzles 133*b* which are connected to a test pad 160 to test. This structure of the inkjet head chip 100*b* may also be applied to the inkjet head chip 100*a* including the plurality of nozzle lines 132*a*, 132*b*, 132*c*, and 132*d* illustrated in FIG. 5.

Figure 7:
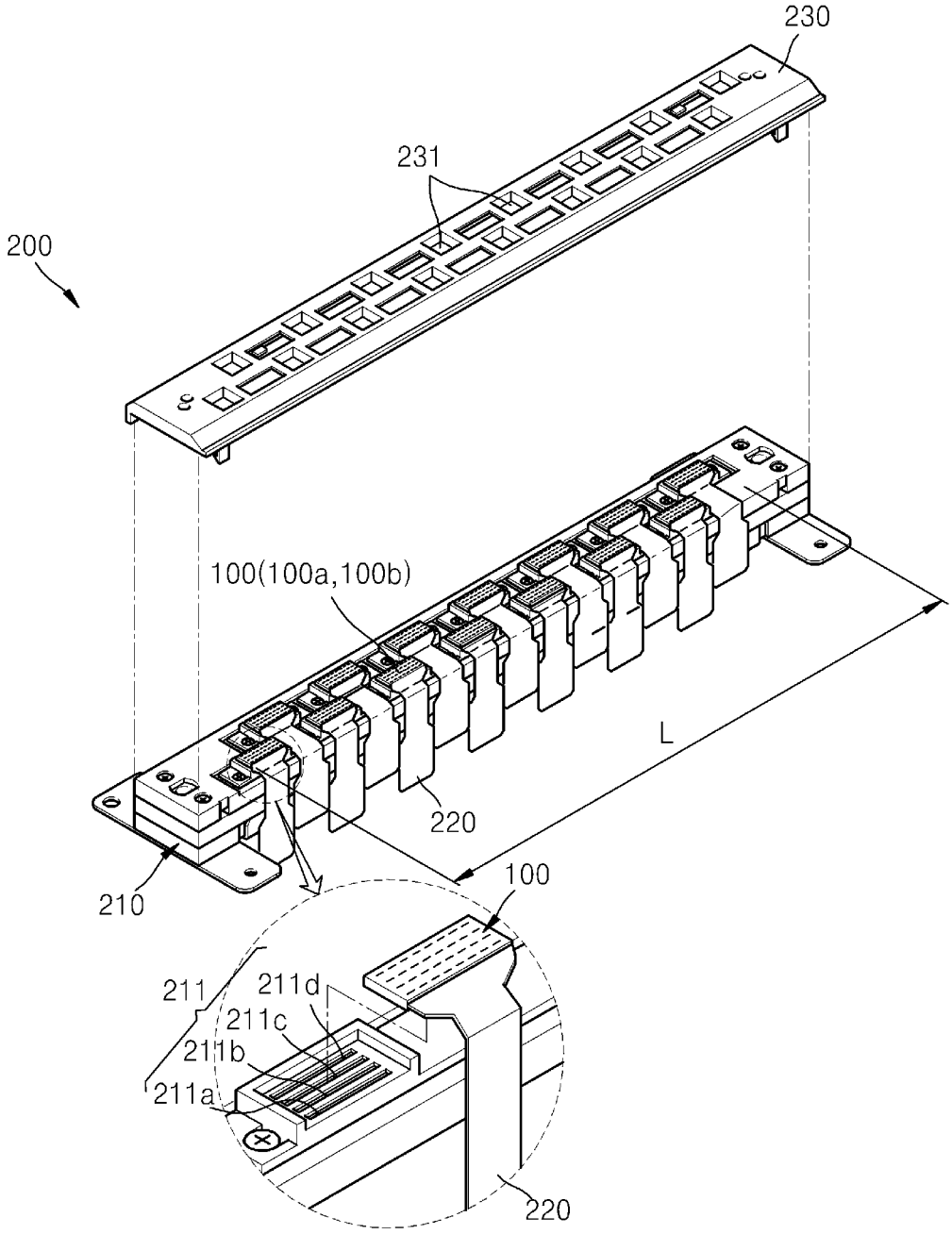
FIG. 7 is an exploded perspective view illustrating an inkjet print head according to an embodiment of the present general inventive concept.

FIG. 7 is an exploded perspective view illustrating an inkjet print head 200 according to an embodiment of the present general inventive concept. Referring to FIG. 7, the inkjet print head 200 according to the present embodiment includes inkjet head chips 100 as described above. The inkjet head chips 100 may be arranged on an upper surface of a base member 210. Connectors 220 are connected to main pads 150 of the inkjet head chips 100. Ink feeders 211 are disposed on the base member 210 in order to feed ink to the inkjet head chips 100. Here, the ink feeders 211 include four ink feeders 211*a*, 211*b*, 211*c*, and 211*d* in order to feed ink to the inkjet head chips 100 each including four nozzle lines. In this regard, each of the inkjet head chips 100 is embodied by the inkjet head chip 100*a* illustrated in FIG. 5 including the four nozzle lines 132*a*, 132*b*, 132*c*, and 132*d*. The ink feeders 211 may be connected to ink cartridges (not illustrated) which are installed on the base member 210. The ink feeders 211 may also be connected to the ink cartridges through ink feeding tubes (not illustrated).

The inkjet head chips 100 may be fixed to the base member 210 by screws or the like or may be bonded to the base member 210 through an adhesive agent or the like. A driving signal to correspond to an image which is to be printed is supplied to the inkjet head chips 100 through the connectors 220. After the plurality of inkjet head chips 100 are fixed onto the base member 210, a cover 230 having openings 231 respectively exposing nozzles of the plurality of inkjet head chips 100 may be combined with the base member 210.

The inkjet print head 200 according to the present embodiment may be an array inkjet print head in which the plurality of inkjet head chips 100 are arrayed in a main scanning direction so that a length "L" of the inkjet print head 200 in the main scanning direction corresponds to a width of a sheet of printing paper on which printing is to be performed. Therefore, the inkjet print head 200 may print an image at a fixed position on the sheet of printing paper which is transferred in a sub-scanning direction. In FIG. 7, the plurality of inkjet head chips 100 are arrayed in two lines in a zigzag formation, but the present general inventive concept is not limited thereto. If necessary, the plurality of inkjet head chips 100 may be arrayed in three or more lines, in a zigzag, straight, or other staggered configuration to constitute one array inkjet print head.

The inkjet head chips 100 applied to the inkjet print head 200 of the present embodiment separately include the test pads 160 as described above. Since the main pads 150 are not used in a test printing process, the main pads 150 may be prevented from being damaged. In a process of manufacturing the inkjet print head 200, inkjet head chips may be sorted out through a plurality of tests so that the inkjet head chips 100 included in the inkjet print head 200 may be grouped to have similar printing characteristics.

A plurality of separate tests may be conducted or repeated on the plurality of inkjet head chips 100. For example, tests may be conducted using the test pads 160 on one group of inkjet head chips 100 to determine a set of printing characteristics such as discharge rates of ink. Another test may be conducted on the same or a different group of inkjet head chips 100 using the test pads 160 to determine a second printing characteristic, such as sizes of ink drops. Another test may be conducted on a same or different group of inkjet head chips 100 using the test pads 160 such as distance between nozzles. Other printing characteristics may be determined and tested. After inkjet head chips with similar printing characteristics are determined, these inkjet head chips may be grouped or sorted together to form inkjet print heads 200.

As a result, an inkjet print head 200 may perform uniform-quality printing in the main scanning direction. A shuttle type inkjet head (not illustrated) using a plurality of inkjet head chips 100 with similar printing characteristics may also perform uniform-quality printing in a main scanning direction as described above. If a shuttle type inkjet head performing color printing separately includes a K color printing inkjet head chip and C, M, and Y color printing inkjet head chips, the K color printing inkjet head chip and the C, M, and Y color printing inkjet head chips having similar printing characteristics may be sorted out and applied without damaging the main pads 150.

Figure 8:
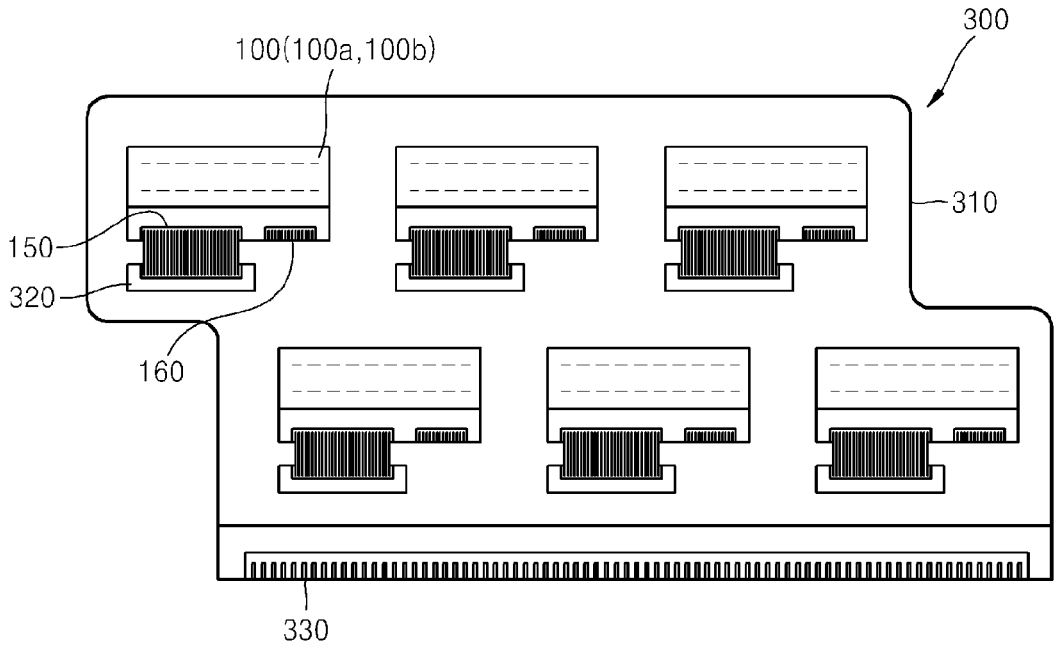
FIG. 8 is a plan view illustrating a head module which is adopted to an inkjet print head according to an embodiment of the present general inventive concept.

The connectors 220 are connected to the inkjet head chips 100 on a one-to-one basis in FIG. 7, but the present general inventive concept is not limited thereto. FIG. 8 is a plan view of a head module 300 formed of a plurality of inkjet head chips according to an embodiment of the present general inventive concept. Referring to FIG. 8, the inkjet head chips 100 separately including the test pads 160 are assembled within a circuit board 310 including a plurality of connection pads 320. As illustrated in FIG. 4, the test connector 170 may be separated from the test pad 160 after the inkjet head chip 100 is completely tested. Also, the inkjet head chips 100 having similar printing characteristics may be arrayed on the circuit board 310, and the connection pads 320 may be connected to main pads 150 using a wire bonding process or the like. This connection process may be performed using an automated manufacturing process. The circuit board 310 may be a multi-layer ceramic circuit board. The plurality of connection pads 320 may be connected to a driver (not illustrated) of an inkjet type image forming apparatus (not illustrated) through a second connection pad 330 so as to transmit a driving signal to print to the inkjet head chips 100.

If a plurality of inkjet head chips not having the test pads 160 are combined with the circuit board 310 without a test, test printing may be performed after an inkjet print head including the inkjet head chips is manufactured, in order to separate inkjet head chips having different printing characteristics from the circuit board 310. However, this process is not easy, and the main pads 150 or the circuit board 310 may be damaged in the separation process. Since the inkjet print head 200 of the present embodiment uses the inkjet head chips 100 including the test pads 160, the main pads 150 may not be damaged at all. Also, since the inkjet print head 200 selectively uses only the inkjet head chips 100 having pre-checked similar printing characteristics, the inkjet print head 200 may have a uniform printing quality. Since the inkjet head chips 100 may be tested and pre-arranged beforehand based on similar printing characteristics, the inkjet head chips 100 may not be required to be separated from the circuit board 310 after the inkjet head chips 100 are combined with the circuit board 310. Thus, productivity of a process of manufacturing inkjet print heads may be improved.

Figure 9:
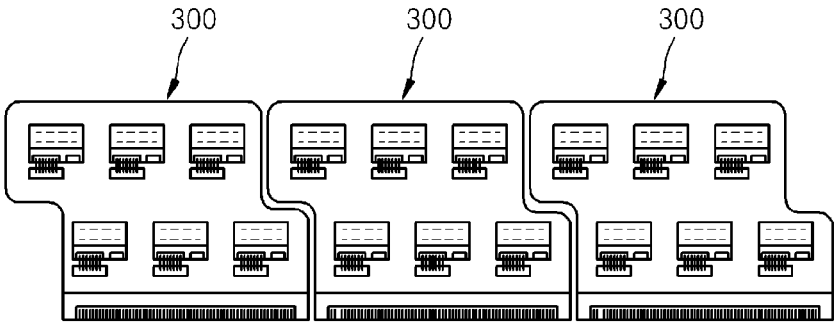
FIG. 9 is a plan view illustrating an inkjet print head adopting a plurality of head modules according to an embodiment of the present general inventive concept.

The plurality of inkjet head chips 100 may be arrayed on the circuit board 310 in order to form one head module 300. A plurality of head modules 300 may be combined with the base member 210 illustrated in FIG. 7 in order to manufacture an array inkjet print head. The head modules 300 having the above-described structures may facilitate manufacture of a large-sized array inkjet print head. In other words, as illustrated in FIG. 9, the plurality of head modules 300 may be arrayed in one direction in order to easily extend a length in a main scanning direction of the array inkjet print head.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims and their equivalents.

What is claimed is:

1. An inkjet head chip comprising:

a plurality of nozzles;

a plurality of discharging units which discharge ink through the plurality of nozzles;

a main pad having a plurality of electrical terminals which is electrically connected to the plurality of discharging units in order to supply a driving signal to the plurality of discharging units, the main pad disposed along a side of the inkjet head chip; and a test pad having a plurality of electrical terminals which supplies a test driving signal to some of the plurality of discharging units to which the main pad is electrically connected to supply the driving signal, the test pad disposed along the side of the inkjet head chip.

2. The inkjet head chip of claim 1, wherein the plurality of nozzles comprise main nozzles to print and test nozzles which are positioned separately from the main nozzles, wherein the test pad is electrically connected to the discharging units which correspond to the test nozzles.

3. The inkjet head chip of claim 1, wherein the plurality of nozzles comprise a plurality of nozzle lines which are spaced apart from one another, wherein the test pad is electrically connected to the discharging units which correspond to at least one nozzle of each of the plurality of nozzle lines.

4. The inkjet head chip of claim 3, wherein at least one of the plurality of nozzle lines discharges different colored ink from ink which is discharged from the other nozzle lines.

5. An inkjet print head comprising:

a plurality of inkjet head chips , each inkjet head chip comprising:

a plurality of nozzles;

a plurality of discharging units to discharge ink through the plurality of nozzles;

a main pad having a plurality of electrical terminals which is electrically connected to the plurality of discharging units in order to supply a driving signal to the plurality of discharging units, the main pad disposed along a side of the inkjet head chip; and a test pad having a plurality of electrical terminals which supplies a test driving signal to some of the plurality of discharging units to which the main pad is electrically connected to supply the driving signal, the test pad disposed along the side of the inkjet head chip; and a plurality of connectors which are electrically connected to the main pads of the plurality of inkjet head chips in order to supply a driving signal to the plurality of inkjet head chips.

6. The inkjet print head of claim 5, wherein the plurality of nozzles comprise main nozzles to print and test nozzles which are positioned separately from the main nozzles, and test pad is electrically connected to discharging units which correspond to the test nozzles.

7. The inkjet print head of claim 5, wherein the plurality of nozzles comprise a plurality of nozzle lines which are spaced apart from one another, wherein the test pad is electrically connected to the discharging units which correspond to at least one nozzle of each of the plurality of nozzle lines.

8. The inkjet print head of claim 7, wherein at least one of the plurality of nozzle lines discharges different colored ink from ink which is discharged from the other nozzle lines.

9. The inkjet print head of claim 5, wherein the plurality of inkjet head chips are arrayed in a length to correspond to a width of a sheet of printing paper.

10. The inkjet print head of claim 9, wherein the plurality of inkjet head chips are arrayed in a zigzag formation.

11. An inkjet print head comprising:

a plurality of inkjet head chips, each inkjet head chip comprising:

a plurality of nozzles;

a plurality of discharging units to discharge ink through the plurality of nozzles;

a main pad having a plurality of electrical terminals which is electrically connected to the plurality of discharging units in order to supply a driving signal to the plurality of discharging units, the main pad disposed along a side of the inkjet head chip; and a test pad having a plurality of electrical terminals which supplies a test driving signal to some of the plurality of discharging units to which the main pad is electrically connected to supply the driving signal, the test pad disposed along the side of the inkjet head chip; and a circuit board which comprises a plurality of connection pads electrically connected to the main pads of the plurality of inkjet head chips.

12. The inkjet print head of claim 11, wherein the plurality of nozzles comprising main nozzles to print and test nozzles which are positioned separately from the main nozzles, and the test pad is electrically connected to discharging units of a plurality of discharging units which correspond to the test nozzles.

13. The inkjet print head of claim 11, wherein the plurality of nozzles comprise a plurality of nozzle lines which are spaced apart from one another, wherein the test pad is electrically connected to the discharging units which correspond to at least one nozzle of each of the plurality of nozzle lines.

14. The inkjet print head of claim 13, wherein at least one of the plurality of nozzle lines discharges different colored ink from ink which is discharged from the other nozzle lines.

15. The inkjet print head of claim 11, wherein the circuit board comprises a multi-layer ceramic circuit board.

16. The inkjet print head of claim 11, wherein the plurality of inkjet head chips are arrayed in a length to correspond to a width of a sheet of printing paper.

17. The inkjet print head of claim 16, wherein the plurality of inkjet head chips are arrayed in a zigzag formation.

18. The inkjet print head of claim 11, wherein the plurality of inkjet head chips are arranged in the circuit boards to form a plurality of head modules.

19. The inkjet print head of claim 18, wherein the plurality of head modules are arrayed in a length which corresponds to a width of a sheet of printing paper.

20. The inkjet print head of claim 19, wherein the plurality of inkjet head chips are arrayed in a zigzag formation.

21. The inkjet head chip of claim 1, wherein the test pad is configured to receive a flexible printed circuit (FPC) test connector.

22. The inkjet print head of claim 11, wherein the test pad is configured to receive a flexible printed circuit (FPC) test connector.

* * * * *